US008360084B1

(12) United States Patent
Robinson

(10) Patent No.: US 8,360,084 B1
(45) Date of Patent: Jan. 29, 2013

(54) MOTORCYCLE CANOPY

(76) Inventor: John M. Robinson, Windermere, FL (US)

( * ) Notice: Subject to any disclaimer, the term of this patent is extended or adjusted under 35 U.S.C. 154(b) by 25 days.

(21) Appl. No.: 13/189,207

(22) Filed: Jul. 22, 2011

(51) Int. Cl.
*E04H 15/36* (2006.01)

(52) U.S. Cl. ..... 135/133

(58) Field of Classification Search ..... 135/133, 135/134, 136, 137
See application file for complete search history.

(56) References Cited

U.S. PATENT DOCUMENTS

| | | | | |
|---|---|---|---|---|
| 3,082,780 | A * | 3/1963 | Macy | 135/130 |
| 3,171,417 | A * | 3/1965 | Stokes | 135/132 |
| 3,906,968 | A * | 9/1975 | Black | 135/132 |
| 4,440,436 | A | 4/1984 | Giddens et al. | |
| 4,560,196 | A | 12/1985 | Carter, Sr. | |
| 4,886,083 | A * | 12/1989 | Gamache | 135/88.06 |
| 5,004,001 | A * | 4/1991 | Bouchard | 135/97 |
| 5,072,987 | A | 12/1991 | Allen | |
| 5,277,214 | A * | 1/1994 | Tolley | 135/133 |
| 5,458,390 | A | 10/1995 | Gilbert | |
| 5,791,718 | A | 8/1998 | Boutin | |
| 7,013,904 | B2 * | 3/2006 | Kofler | 135/132 |
| 7,640,942 | B2 * | 1/2010 | Chu | 135/132 |
| 2006/0054208 | A1 * | 3/2006 | Romano | 135/132 |
| 2006/0102222 | A1 * | 5/2006 | Zebley | 135/133 |
| 2012/0031321 | A1 * | 2/2012 | Ying | 114/361 |

* cited by examiner

*Primary Examiner* — Noah Chandler Hawk

(57) ABSTRACT

A motorcycle canopy to protect a motorcycle and a motorcyclist during a rain storm including a collapsible main frame with sub-frames, formed of cylindrical fiberglass rods, pivotally attached to a pivotal body, a waterproof canopy body having sleeves in which the sub-frames are disposed, a mesh screen disposed in the front and rear end of the canopy body for air circulation and heat exhaustion, and a window disposed in the canopy body proximal to a center frame. Securement straps attached to the center frame, a cross-strap disposed across the center frame, and front straps disposed between an upper frame and a motorcycle handlebar secure the device in place during windy conditions.

7 Claims, 4 Drawing Sheets

MOTORCYCLE CANOPY

BACKGROUND OF THE INVENTION

Various types of vehicle-covering devices are known in the prior art. However, what is needed is a motorcycle canopy including a collapsible main frame with sub-frames, formed of cylindrical fiberglass rods, pivotally attached to a pivotal body, a canopy body having sleeves in which the sub-frames are disposed, a mesh screen disposed in the front and rear end of the canopy body for air circulation and heat exhaustion, and a window disposed in the canopy body proximal to a center sub-frame.

FIELD OF THE INVENTION

The present invention relates to canopies, and more particularly, to a motorcycle canopy.

SUMMARY OF THE INVENTION

The general purpose of the present motorcycle canopy, described subsequently in greater detail, is to provide a motorcycle canopy which has many novel features that result in a motorcycle canopy which is not anticipated, rendered obvious, suggested, or even implied by prior art, either alone or in combination thereof.

To accomplish this, the present motorcycle canopy includes a collapsible main frame having a U-shaped center frame having a pair of outer ends, a first half portion disposed on one side of the center frame and a second half portion disposed on an opposite side of the center frame from the first half portion. Each of the first half portion and the second half portion includes a U-shaped upper frame having a pair of outside ends pivotally attached to a pivotal body disposed proximal to the center frame outer ends; a U-shaped lower frame having a pair of outer edges pivotally attached to one of the pivotal bodies; and a U-shaped base frame having a pair or external ends pivotally attached to one of the pivotal bodies. Each of the center frame outer ends also attach to one of the pivotal bodies. The center, upper, and lower frames are continuously disposed within spaced apart sleeves disposed in a waterproof canopy body. The pivotal attachment of the frames to the pivotal body as well as the disposition of the frames within the sleeves permits the main frame and the canopy body to collapse for convenient transport of the device. A cross-strap is disposed between the first side and the second side of the center frame, while securement first and second straps are attached to the center frame and front straps are removably disposed between one of the upper frames and a motorcycle handlebar. The cross-straps, first and second straps, and front straps lend stability to the main frame which is critical for preventing collapse of the main frame and canopy body during a rain storm accompanied by windy conditions. A mesh screen centrally disposed in the canopy body between the base sleeves and the lower sleeves on each side of the center sleeve allow heat to escape from the canopy body as well as permit air to circulate therein. A transparent window member, which can also be tinted, is disposed in the canopy body between the center sleeve and one of the upper sleeves to permit a motorcyclist to see what is happening outside of the canopy body while sitting inside the canopy body. Reflective lettering disposed on the canopy body provides an advisory message, including "CAUTION PERSONNEL INSIDE", to motorists passing by the device when in use. The main frame and canopy body are configured to contain a motorcycle as well as a motorcyclist positioned in a seated position inside the main frame and canopy body. Each of the center frames, the upper frames, the lower frames, and the base frames are formed of cylindrical fiberglass rods. The main frame accommodates motorcycles ranging in length from approximately 7 feet to 11 feet, although the device may also be modified to cover other types of two-wheeled vehicles such as bicycles and also snow mobiles.

The present device is quickly set up to provide protection to both a motorcyclist and a motorcycle when encountering an unanticipated rain storm. The device eliminates the need to race toward an overpass or gas station with an overhang to escape the rain storm. The light weight fireproof mold resistant waterproof canopy body reduces the load carried by the motorcycle and also reduces the weight required to be lifted by the motorcyclist to set up the device while further reducing mold from developing during transport of the device after the rain storm. After the rain storm, the motorcyclist quickly folds up the device, tucks the device into a pouch or saddle bag, and goes on his way without being soaked by the rain storm. The vents allow fresh air circulation while inside the device. The securement straps allow a motorcyclist to hold the device down during the rain storm to prevent the device from blowing away thus securing the device in a position to cover and protect the motorcyclist and motorcycle. The reflective highly visible lettering along the front side and the back side of the device to notify other motorists of the presence of a motorcycle and motorcyclist within the device. The canopy body is also fire resistant to reduce the potential of fire from backfiring of the motorcycle engine.

Thus has been broadly outlined the more important features of the present motorcycle canopy so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
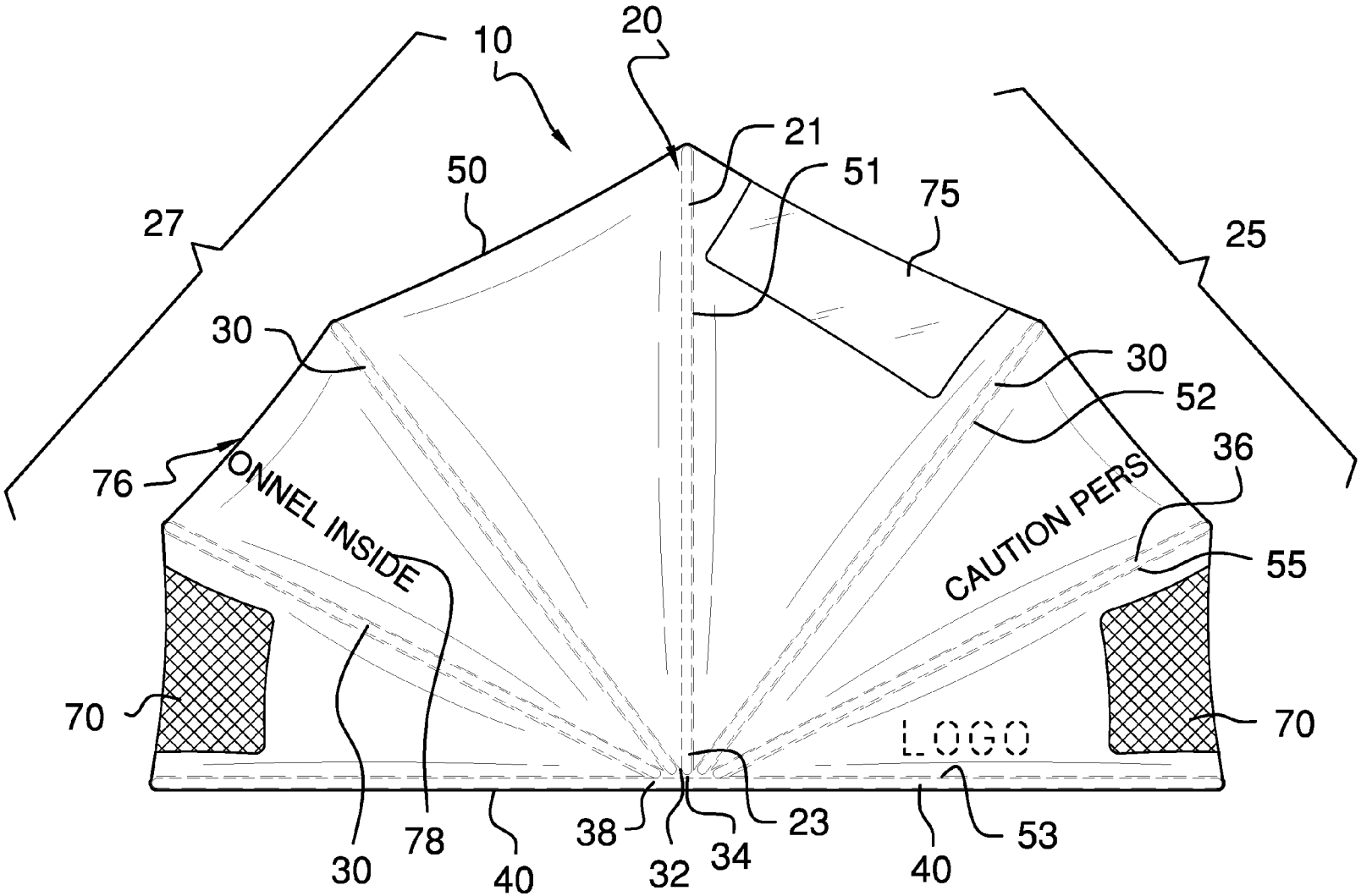
FIG. 1 is a side elevation view.
Figure 2:
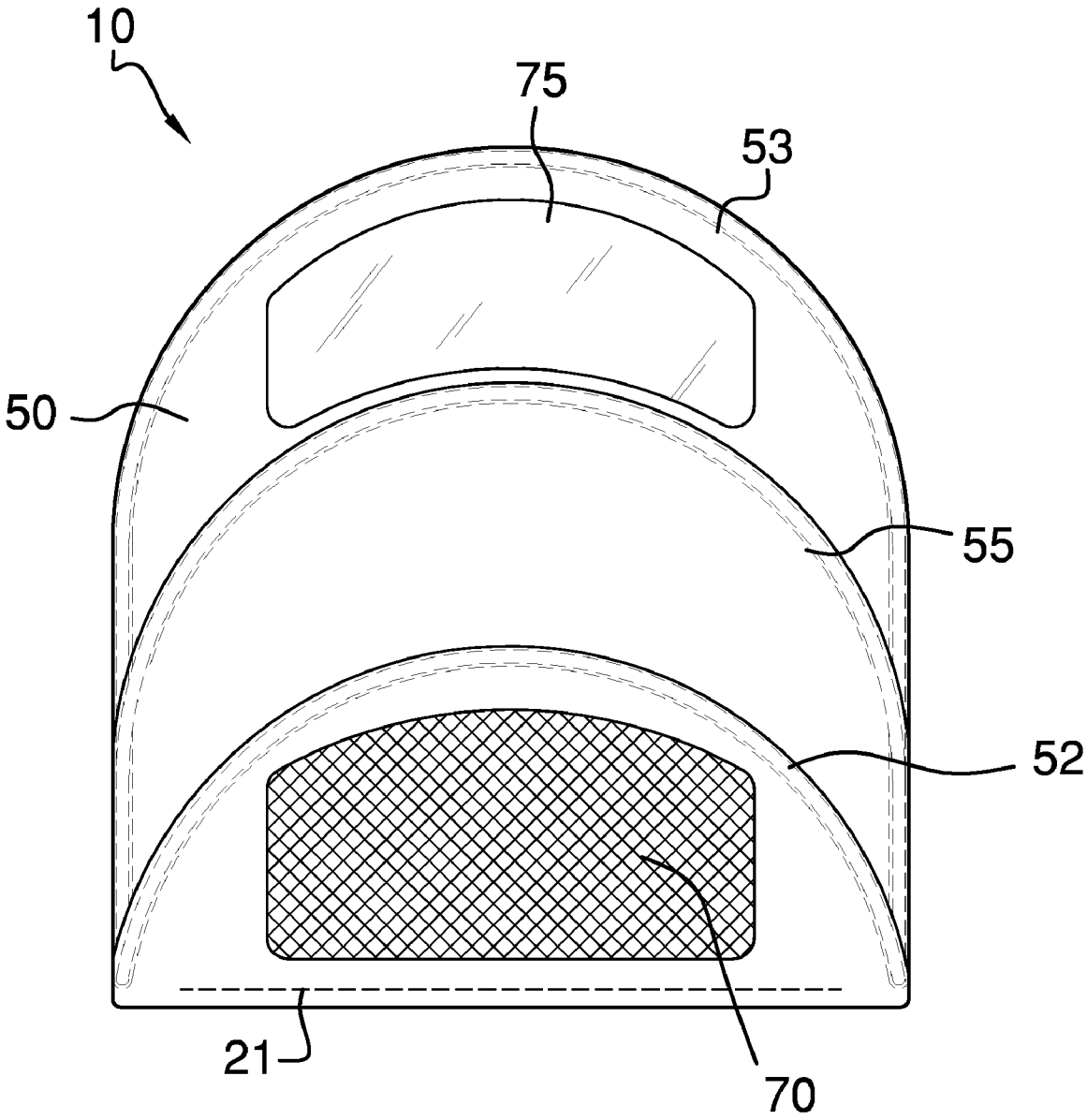
FIG. 2 is a front elevation view.
Figure 3:
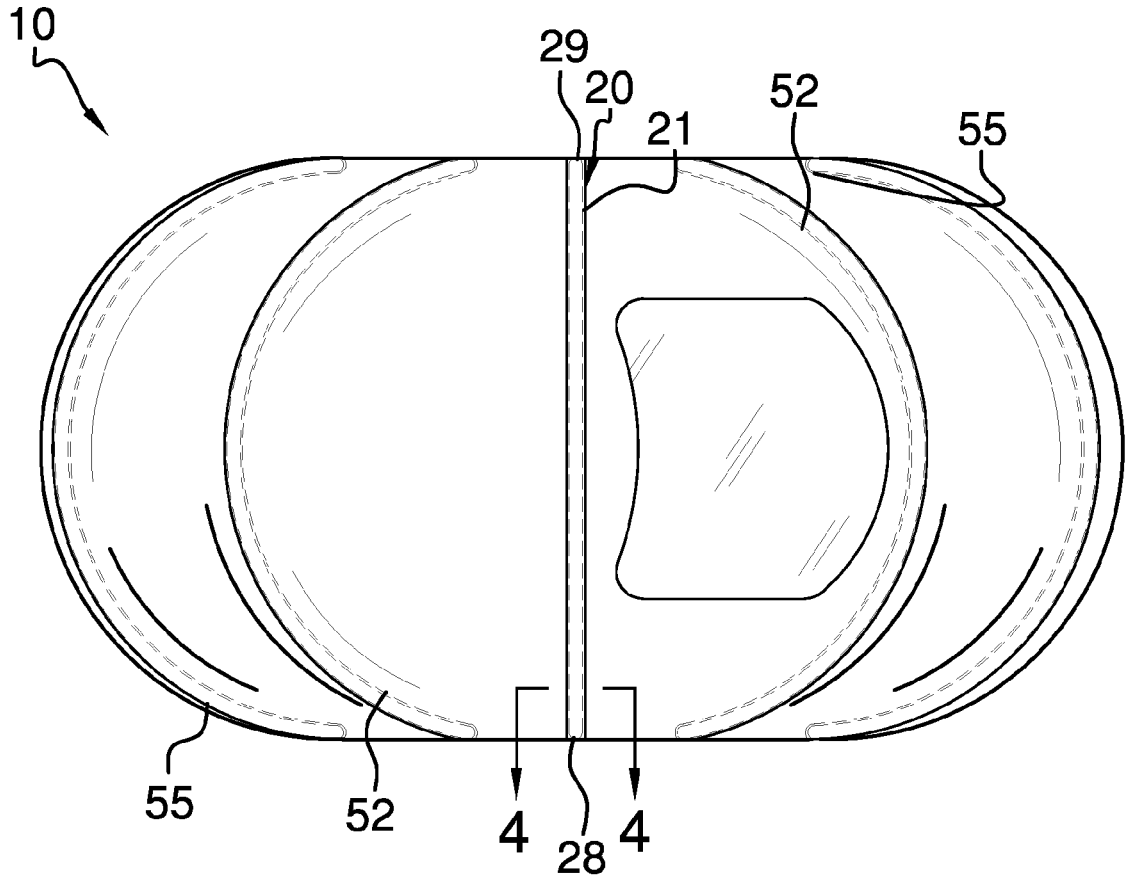
FIG. 3 is a top plan view.
Figure 4:
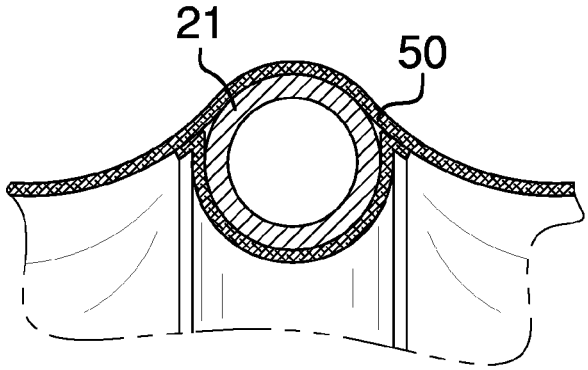
FIG. 4 is a cross-sectional view taken along line 4-4 of FIG. 3.
Figure 5:
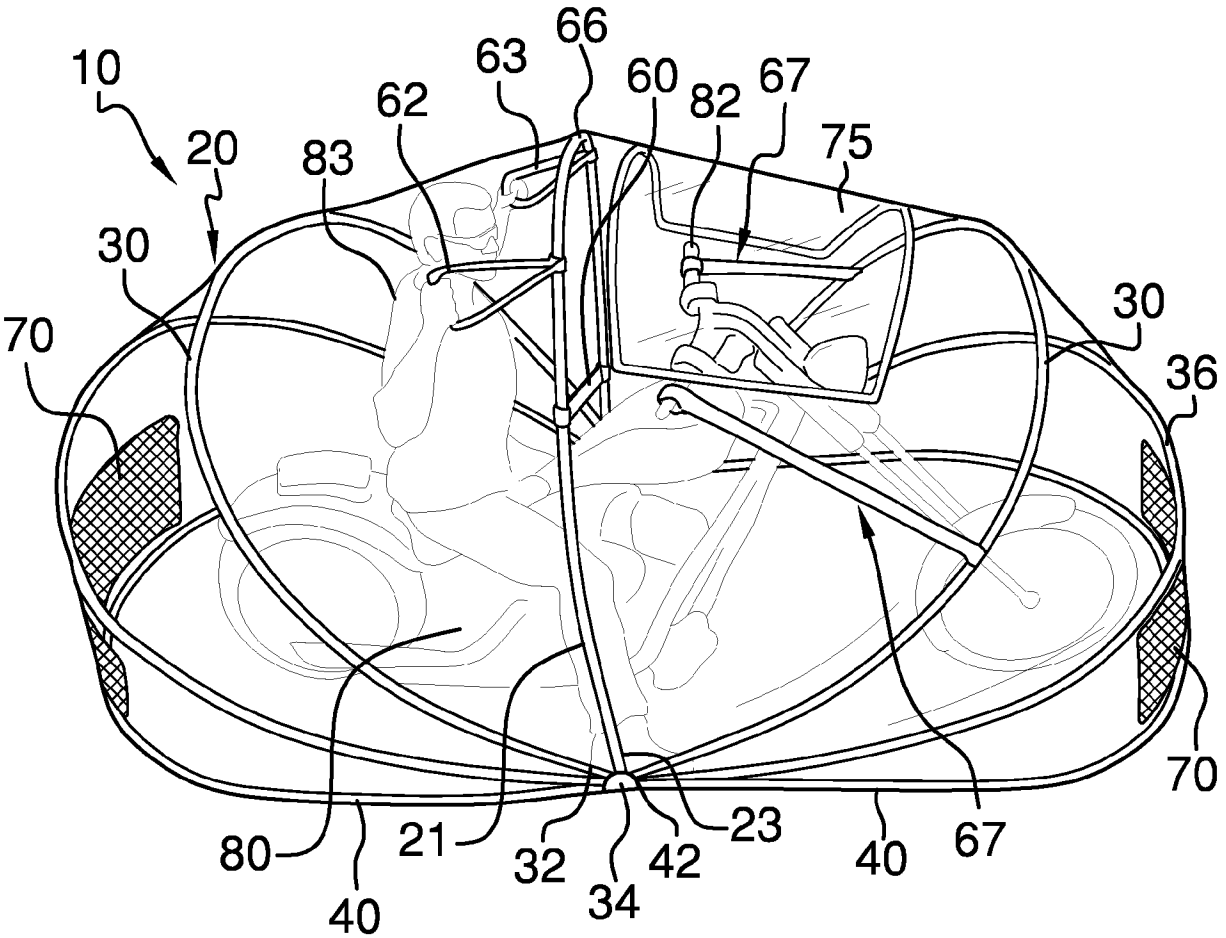
FIG. 5 is an in-use isometric view.

With reference now to the drawings, and in particular FIGS. 1 through 5 thereof, example of the instant motorcycle canopy employing the principles and concepts of the present motorcycle canopy and generally designated by the reference number 10 will be described.

Referring to FIGS. 1 through 5 a preferred embodiment of the present motorcycle canopy 10 is illustrated. The motorcycle canopy 10 includes a collapsible main frame 20 having a U-shaped center frame 21 having a pair of outer ends 23, a first half portion 25 disposed on one side of the center frame 21 and a second half portion 27 disposed on an opposite side of the center frame 21 from the first half portion 25. The center frame 21 has a first side 28 and a second side 29.

A U-shaped upper frame 30 is included in each of the first half and the second half portions 25, 27. Each of the upper frames 30 has a pair of outside ends 32 pivotally attached to a pivotal body 34 disposed proximal to each of the center frame 21 outer ends 23. A U-shaped lower frame 36 is also included in each of the first half and second half portions 25, 27. Each of the lower frames 36 has a pair of outer edges 38 pivotally attached to one of the pivotal bodies 34. A U-shaped base frame 40 is further included in each of the first half and the second half portions 25, 27. Each of the base frames 40 has a pair of external ends 42 pivotally attached to one of the pivotal bodies 34. Each of the center frame 21 outer ends 23 also attach to one of the pivotal bodies 34. Each of the center frame 21, the upper frames 30, the lower frames 36, and the base frames 40 are formed of cylindrical fiberglass rods.

The present device 10 also includes a substantially semi-hemispherical waterproof canopy body 50. The canopy body 50 includes a center sleeve 51 continuously centrally disposed along a vertical midline axis of the canopy body 50. The center frame 21 is disposed within the center sleeve 51. A U-shaped upper sleeve 52 is centrally disposed on each side of the center sleeve 52. Each upper frame 30 is disposed within one of the upper sleeves 52. A U-shaped base sleeve 53 is disposed along an outer perimeter 55 of the canopy body 50 on each side of the center sleeve 51. Each base frame 40 is disposed within one of the base sleeves 53. A U-shaped lower sleeve 55 is disposed between the base sleeve 53 and the upper sleeve 52 on each side of the center sleeve 51. Each lower frame 36 is disposed within one of the lower sleeves 55. The pivotal attachment of the frames 21, 30, 36, 40 to the pivotal body 34 as well as the disposition of the frames 21, 30, 36, 40 within the sleeves 51, 52, 53, 55 permits the main frame 20 and the canopy body 50 to collapse for convenient transport of the device 10.

A cross-strap 60 is continuously disposed between the first side 28 and the second side 29 of the center frame 21. The cross-strap 60 lends stability to the main frame 20 which is critical for preventing collapse of the main frame 20 and canopy body 50 during a rain storm accompanied by windy conditions.

The present motorcycle canopy 10 also includes a securement first strap 62 and a securement second strap 63. Each of the securement first and second straps 62, 63 has an apex 66, which is attached to one of the first side 28 and the second side 29 of the center frame 21 in a position proximal to a center point 66 of the center frame 21. The securement first and second straps 62, 63 permit a motorcyclist 83 to further stabilize the main frame 20 and the canopy body 50 during windy conditions.

A pair of front straps 67 is also included. Each of the front straps 67 is removably disposed between one of the upper frames 30 and a motorcycle 80 handlebar 82. The front straps 67 also serve to stabilize the main frame 20 and the canopy body 50 during windy conditions.

A mesh screen 70 is centrally disposed in the canopy body 50 between the base sleeve 53 and the lower sleeve 55 on each side of the center sleeve 51. The mesh screens 70 allow heat to escape from the canopy body 50 as well as permit air to circulate therein.

A transparent window member 75 is disposed in the canopy body 50 between the center sleeve 51 and one of the upper sleeves 52. The window member 75 permits a motorcyclist 83 to see what is happening outside of the canopy body 50 while sitting atop the motorcycle 80 inside the canopy body 50. A plurality of reflective lettering 76 is disposed on the canopy body 50 between at least one of the lower sleeves 55 and one of the base sleeves 53. The lettering 76 is configured to provide an advisory message 78 to motorists passing by the device 10 when in use. The advisory message 78 is "CAUTION PERSONNEL INSIDE" or a similar warning, such as "Warning—Cycle and Rider Inside". The reflective lettering 76 notifies motorists passing by the device 10 when in use that a motorcyclist 83 and motorcycle 80 are covered by the canopy body 50.

The main frame 20 and canopy body 50 are configured to contain a motorcycle 80 as well as a motorcyclist 83 positioned in a seated position underneath the main frame 20 and canopy body 50.

What is claimed is:

1. A motorcycle canopy comprising:

a collapsible main frame having a U-shaped center frame having a pair of outer ends, a first half portion disposed on one side of the center frame, and a second half portion disposed on an opposite side of the center frame from the first half portion, wherein the center frame has a first side and a second side;

a U-shaped upper frame of each of the first half and the second half portions, each of the upper frames having a pair of outside ends pivotally attached to one of a pivotal body disposed proximal to each of the center frame outer ends;

a U-shaped lower frame of each of the first half and second half portions, each of the lower frames having a pair of outer edges pivotally attached to one of the pivotal bodies;

a U-shaped base frame of each of the first half and the second half portions, each of the base frames having a pair of external ends pivotally attached to one of the pivotal bodies;

wherein each of outer ends of the center frame pivotally attach to one of the pivotal bodies;

a substantially semi-hemispherical waterproof canopy body comprising:

a center sleeve continuously centrally disposed along a vertical midline axis of the canopy body, wherein the center frame is disposed within the center sleeve;

a U-shaped upper sleeve centrally disposed on each side of the center sleeve, wherein each upper frame is disposed within one of the upper sleeves;

a U-shaped base sleeve disposed along an outer perimeter of the canopy body on each side of the center sleeve, wherein each base frame is disposed within one of the base sleeves;

a U-shaped lower sleeve disposed between the base sleeve and the upper sleeve on each side of the center sleeve, wherein each lower frame is disposed within one of the lower sleeves;

a cross-strap continuously disposed between the first side and the second side of the center frame;

a securement first strap;

a securement second strap;

an apex of each of the first and second straps, wherein each apex is attached to one of the first side and the second side of the center frame in a position proximal to a center point of the center frame;

a mesh screen centrally disposed in the canopy body between the base sleeve and the lower sleeve on each side of the center sleeve;

a transparent window member disposed in the canopy body between the center sleeve and one of the upper sleeves; and a pair of front straps, each of the front straps removably disposed between one of the upper frames and a motorcycle handlebar.

2. The motorcycle canopy of claim 1 wherein the window member is tinted.

3. A motorcycle canopy comprising:

a collapsible frame having a U-shaped center frame having a pair of outer ends, a first half portion disposed on one side of the center frame and a second half portion disposed on an opposite side of the center frame from the first half portion, wherein the center frame has a first side and a second side;

a U-shaped upper frame of each of the first half and the second half portions, each of the upper frames having a pair of outside ends pivotally outer ends;

a U-shaped lower frame of each of the first half and second half portions, each of the lower frames having a pair of outer edges pivotally attached to one of the pivotal bodies;

a U-shaped base frame of each of the first half and the second half portions, each of the base frames having a pair or external ends pivotally attached to one of the pivotal bodies;

where each of the center frame outer ends attach to one of the pivotal bodies;

wherein each of the center frames, the upper frames, the lower frames, and the base frames are formed of cylindrical fiberglass rods;

a substantially semi-hemispherical waterproof canopy body comprising:

a center sleeve continuously centrally disposed along a vertical midline axis of the canopy body, wherein the center frame is disposed within the center sleeve;

a U-shaped upper sleeve centrally disposed on each side of the center sleeve, wherein each upper frame is disposed within one of the upper sleeves;

a U-shaped base sleeve disposed along an outer perimeter of the body on each side of the center sleeve, wherein each base frame is disposed within one of the base sleeves;

a U-shaped lower sleeve disposed between the base sleeve and the upper sleeve on each side of the center sleeve, wherein each lower frame is disposed within one of the lower sleeves;

a cross-strap continuously disposed between the first side and the second side of the center frame;

a securement first strap;

a securement second strap;

an apex of each of the first and second straps, wherein each apex is attached to one of the first side and the second side of the center frame in a position proximal to a center point of the center frame;

a mesh screen centrally disposed in the canopy body between the base sleeve and the lower sleeve on each side of the center sleeve;

a transparent window member disposed in the canopy body between the center sleeve and one of the upper sleeves; and a pair of front straps, each of the front straps removably disposed between one of the upper frames and a motorcycle handlebar.

4. The motorcycle canopy of claim 3 further comprising:

a plurality of reflective lettering disposed on the canopy body.

5. The motorcycle canopy of claim 4 wherein the lettering is disposed between at least one of the lower sleeves and one of the base sleeves.

6. The motorcycle canopy of claim 5 wherein the lettering is configured to provide an advisory message.

7. The motorcycle canopy of claim 6 wherein the advisory message is “CAUTION PERSONNEL INSIDE”.

* * * * *